US012655488B2

(12) United States Patent
Oda et al.

(10) Patent No.: US 12,655,488 B2
(45) Date of Patent: Jun. 16, 2026

(54) METHOD FOR PRODUCING CHROMIUM-CONTAINING MOLTEN STEEL

(71) Applicant: JFE STEEL CORPORATION, Tokyo (JP)

(72) Inventors: Nobuhiko Oda, Tokyo (JP); Futoshi Ogasawara, Tokyo (JP); Kentaro Kakigi, Tokyo (JP); Takayoshi Fukuyama, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 496 days.

(21) Appl. No.: 18/022,791

(22) PCT Filed: Aug. 23, 2021

(86) PCT No.: PCT/JP2021/030760
§ 371 (c)(1),
(2) Date: Feb. 23, 2023

(87) PCT Pub. No.: WO2022/054553
PCT Pub. Date: Mar. 17, 2022

(65) Prior Publication Data

US 2023/0304110 A1 Sep. 28, 2023

(30) Foreign Application Priority Data

Sep. 10, 2020 (JP) ..... 2020-151817

(51) Int. Cl.
*C21C 7/00* (2006.01)
*C21C 5/28* (2006.01)
*C21C 7/068* (2006.01)

(52) U.S. Cl.
CPC ..... *C21C 7/0025* (2013.01); *C21C 5/28* (2013.01); *C21C 7/068* (2013.01)

(58) Field of Classification Search
CPC ..... C21C 7/0025; C21C 5/28; C21C 7/068; C21C 7/0037; C21C 7/0068; C21C 5/36;
(Continued)

(56) References Cited

U.S. PATENT DOCUMENTS 6,679,931 B1 1/2004 Gotzinger et al.
2008/0156144 A1 7/2008 Jung et al.
2013/0025413 A1 1/2013 Yoshino et al.

FOREIGN PATENT DOCUMENTS

CN 1146497 A 4/1997
CN 101210288 A 7/2008
(Continued)

OTHER PUBLICATIONS

JPH0987722A Translation (Year: 1997).*
(Continued)

*Primary Examiner* — Danielle M. Carda
(74) *Attorney, Agent, or Firm* — Oliff PLC

(57) ABSTRACT

A method for producing chromium-containing molten steel from a raw material including a chromium-containing raw material includes a first step in which a slag basicity before rough decarburization by oxygen blowing is adjusted to be not less than 1.5 and not more than 3.0, a slag basicity after rough decarburization by oxygen blowing is adjusted to be not less than 2.0 and not more than 3.5, and then tapping is performed while slag containing a chromium oxide generated by the oxygen blowing is made to remain in the furnace, and a second step in which the slag containing a chromium oxide made to remain is reduced by using a carbon source or a metal source newly added into the same furnace so that chromium is recovered into molten steel. The slag basicity is determined by dividing a CaO concentration by an $SiO_2$ concentration on a mass basis in the slag.

4 Claims, 1 Drawing Sheet

(58) Field of Classification Search
CPC .. C21C 5/54; C21C 7/06; C21C 5/005; C21C 5/30; C21C 7/072; C21C 2250/02; Y02P 10/20
USPC ..... 75/548
See application file for complete search history.

(56) References Cited

FOREIGN PATENT DOCUMENTS

| | | | | |
|---|---|---|---|---|
| CN | 102892906 | A | | 1/2013 |
| EP | 0 779 373 | A1 | | 6/1997 |
| EP | 2692873 | A1 | | 2/2014 |
| JP | H06-073424 | A | | 3/1994 |
| JP | H07-062413 | A | | 3/1995 |
| JP | H07216429 | A | | 8/1995 |
| JP | H08-085814 | A | | 4/1996 |
| JP | H08295914 | A | | 11/1996 |
| JP | H09-087722 | A | | 3/1997 |
| JP | H0987722 | A | * | 3/1997 |
| JP | H10-025507 | A | | 1/1998 |
| JP | H10-265827 | A | | 10/1998 |
| JP | 2002-256323 | A | | 9/2002 |
| JP | 2012-211372 | A | | 11/2012 |
| JP | 2013-79449 | A | | 5/2013 |
| JP | 2013-151747 | A | | 8/2013 |

OTHER PUBLICATIONS

Oct. 8, 2024 Office Action issued in European Patent Application No. 21 866 513.1.
May 15, 2024 Office Action issued in Korean Patent Application No. 10-2023-7011474.
Nov. 2, 2021 International Search Report issued in International Patent Application No. PCT/JP2021/030760.
Oct. 4, 2022 Office Action issued in Japanese Patent Application No. 2021-566453.
Feb. 7, 2024 extended Search Report issued in European Patent Application No. 21866513.1.
Mar. 1, 2025 Office Action issued in Chinese Patent Application No. 202180052626.5.

* cited by examiner

METHOD FOR PRODUCING CHROMIUM-CONTAINING MOLTEN STEEL

TECHNICAL FIELD

The present invention relates to a method for producing chromium-containing molten steel by use of a steelmaking refining furnace.

BACKGROUND ART

A refining step of chromium-containing molten steel mainly adopts a method in which a raw material including a chromium-containing raw material is melted and then supplied with oxygen so as to be subjected to decarburization blowing, and after oxygen blowing is terminated, a reducing agent such as an Si-containing raw material or an Al-containing raw material is added so that a chromium content, which is a valuable metal, is recovered from chromium oxide generated concurrently with oxidation of carbon into molten steel, which then is tapped.

Reducing the thus-generated chromium oxide requires a chemically-equivalent amount of reducing agent, i.e., requires a substantial amount of Si alloy or Al alloy, which is costly. In addition to the above, it is also required to add CaO so as to adjust the slag composition with respect to $SiO_2$ or $Al_2O_3$ generated at the time of reducing chromium oxide, causing the cost of lime and the amount of generated slag to increase. In particular, the slag generated in this step includes chromium oxide in a certain concentration and has the disadvantage that hexavalent chromium might be eluted when the slag is used, as a by-product, as a roadbed material or an aggregate.

In order to reduce the used amount of Si-containing raw material or Al-containing raw material, a method has been studied in which a process is ended without performing reduction of slag containing chromium oxide, and thereafter the reduction is performed by using hot metal or a carbon-containing raw material. For example, Patent Literature 1 discloses a method or the like in which slag draining or slag removal is performed without performing reduction after oxygen blowing, and resulting slag is subjected to reduction in an electric furnace by using carbon or silicon so that chromium is recovered into molten steel.

Patent Literature 2 discloses a method in which tapping is conducted without reducing generated slag containing chromium oxide, and hot metal is charged in a refining furnace and then a carbonaceous material is added and oxygen is blown to the refining furnace, so that chromium is recovered into molten iron.

Patent Literature 3 discloses a method or the like in which generated slag containing chromium oxide is solidified by adding calcium carbonate without being reduced so that only molten steel is tapped, and the slag containing chromium oxide is separately removed and then charged in an electric furnace so as to be subjected to a reduction process, so that chromium is recovered into molten iron.

CITATION LIST

Patent Literature

Patent Literature 1: JP-2013-79449A
Patent Literature 2: JP-2002-256323A
Patent Literature 3: JP-2012-211372A

SUMMARY OF INVENTION

Technical Problem

The above-described conventional techniques present the following problems.

The method described in Patent Literature 1 involves charging slag containing chromium oxide after being subjected to removal in a different refining vessel again, which disadvantageously results in considerable heat loss to thus increase power costs or costs for heating a carbonaceous material or the like.

In the method described in Patent Literature 2, when slag is removed while keeping slag containing chromium oxide remaining, the slag might adhere to a vicinity of the furnace wall, the furnace throat, or the tap hole, which disadvantageously results in degradation of operations.

The method described in Patent Literature 3 may solve the above-described slag-adhesion problem by solidifying slag containing chromium oxide. However, the decomposition reaction of calcium carbonate is an endothermic reaction and causes a decrease in the temperature of the slag, which disadvantageously results in an increase in power costs or costs for heating a carbonaceous material or the like in a step of recovering chromium.

The present invention has been made in view of the foregoing circumstances and is to propose a method for producing chromium-containing molten steel that achieves, without affecting operations, with reduced costs and a reduced generation amount of waste.

Solution to Problem

As a result of repeated various experiments for solving the above-described problems, the inventors have made the following findings. That is, with attention focused on the fact that a solid fraction and a viscous property of slag containing chromium oxide obtained after oxygen supply largely vary depending on the basicity of the slag, the slag containing chromium oxide is made to remain in a furnace and is reduced in the same refining furnace by using a carbon source or a metal source newly added thereto, so that it is possible to produce chromium-containing molten steel that achieves, without affecting operations, reduced costs and a reduced generation amount of waste. The present invention has been made based on the above-described findings and can be summarized below.

The method for producing chromium-containing molten steel according to the present invention for advantageously solving the above-described problems includes, using a steelmaking refining furnace, melting and heating a raw material containing a chromium-containing raw material and performing rough decarburization by oxygen blowing. The method is characterized by having the first step of adjusting the slag basicity before the rough decarburization by oxygen blowing in the range of not less than 1.5 and not more than 3.0 and the slag basicity after the rough decarburization by oxygen blowing in the range of not less than 2.0 and not more than 3.5 and then performing tapping while keeping the slag containing chromium oxide generated by the oxygen blowing remaining in the furnace, and the second step of reducing the remaining slag containing chromium oxide by a carbon source or a metal source newly added into the same furnace to recover chromium into molten steel. In the method, the slag basicity is determined by dividing the CaO concentration by the $SiO_2$ concentration on a mass basis in the slag.

The method for producing chromium-containing molten steel according to the present invention can conceivably provide a more preferred solution by including, for example:

(a) adding and melting CaO-containing raw material during the oxygen blowing in the first step;

(b) setting, in the first step, the slag basicity before the rough decarburization by the oxygen blowing, which is hereinafter referred to as "(C/S)pre", and the slag basicity after the rough decarburization by the oxygen blowing, which is hereinafter referred to as "(C/S) post", to satisfy formula (1):

$$(C/S)\text{post}-(C/S)\text{pre}\geq -0.2 \quad (1); \text{ and}$$

(c) setting, in the first step, after the oxygen blowing, the concentration of the chromium oxide in the slag to be in the range of not less than 5 mass % and not more than 50 mass % by using one or two types selected from an Si-containing raw material and an Al-containing raw material.

Advantageous Effects of Invention

The present invention can produce chromium-containing molten steel at reduced costs and with a reduced amount of generated slag without affecting operations by keeping slag containing chromium oxide remaining in a furnace and reducing the slag in the same refining furnace with a carbon source or a metal source newly added thereto, contributing to a reduction in environmental burden.

DESCRIPTION OF EMBODIMENT

Figure 1:
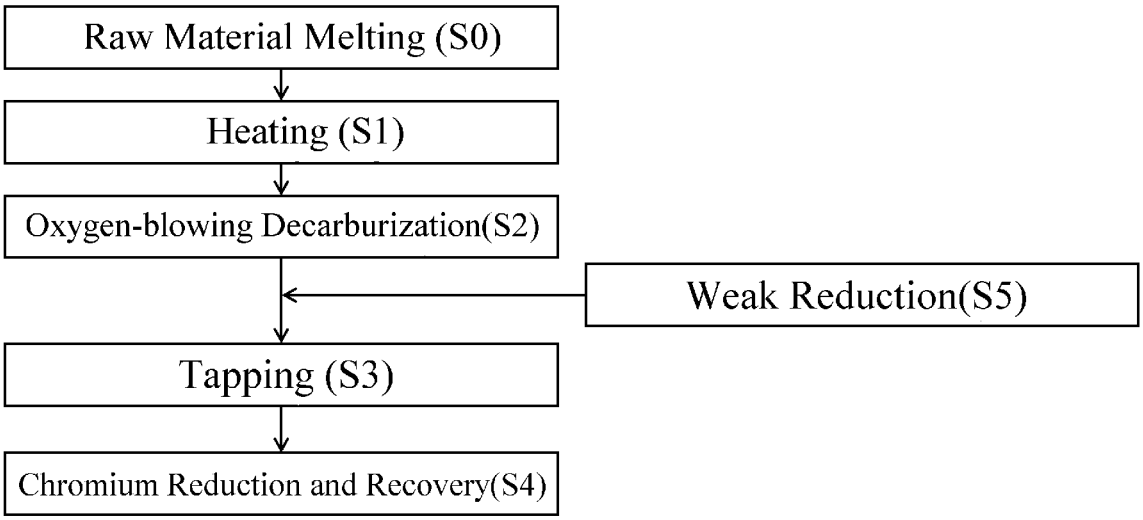
FIG. 1 is a flowchart showing a basic configuration of a method for producing chromium-containing molten steel according to an embodiment of the present invention.

A description is given of an approach taken to reach the findings of the present invention.

Chromium oxide has a melting point as extremely high as 2300° C. Slag containing chromium oxide obtained after a supply of oxygen to chromium-containing molten metal is at about 1700° C. and is high in content of chromium oxide, thus having a low liquid phase ratio and extremely high viscosity. Accordingly, in a case where only molten steel is tapped without reducing the slag containing chromium oxide, the slag remains in a large amount as adherent slag in the vicinity of the furnace wall, furnace throat, or tap hole, resulting in impairing operations.

For example, in a furnace with a relatively large capacity, such as a converter or an AOD furnace, the furnace throat tends to be increasingly narrowed. Because of this, the linear flow velocity of exhaust gas discharged through the furnace throat is increased to increase the generation amount of chromium-containing dust. As a result, the amount of Cr discharged to the outside of the system is increased.

To address this issue, with attention focused on the fact that a relationship between the liquid phase ratio of slag containing chromium oxide and slag basicity largely varies depending on the concentration of chromium oxide ($Cr_2O_3$), the inventors have discovered a method for keeping slag containing chromium oxide remaining in a furnace without affecting operations. The inventors have further found a method for producing chromium-containing molten steel at reduced costs and with a reduced generation amount of slag, by reducing the slag in the same refining furnace using a carbon source or a metal source newly added thereto.

In particular, we found that slag with a high chromium oxide concentration has a high liquid phase ratio at a high basicity, while slag with a low chromium oxide concentration has a high liquid phase ratio at a low basicity. For example, at the prime stage of decarburization after the end of the heating step, the chromium oxide concentration in the slag is not high, and thus the liquid phase ratio of the slag increases as the slag basicity decreases, resulting in a reduction in the adhesion of the slag to the furnace wall. On the other hand, at the final stage of oxygen blowing in which an increased amount of chromium oxide is generated, increasing the slag basicity rather increases the liquid phase ratio of the slag, resulting in a reduction in the adhesion of the slag to the furnace wall. In an ordinary oxygen blowing step, Si in a main raw material used or an auxiliary raw material used is combusted, and thus the slag basicity decreases toward the latter half of blowing, so that compositions of the slag before and after oxygen-blowing decarburization both need to be designed.

Here, the heating step may be performed by adding a carbonaceous material and blowing oxygen. In such a case, the duration until a temperature T(K) during the oxygen blowing is increased to a value higher than a temperature value expressed by an equilibrium formula (2) shown below can be regarded as the heating-up step. Here, $a_{Cr}$ represents an activity of Cr in molten metal, ac represents an activity of C in the molten metal, and $P_{Co}$ represents an atmospheric partial pressure (atm) of CO.

[Mathematical Formula 1]

$$T = \frac{13520}{8.48 - \log\left(\frac{a_{Cr}^{2/3} \cdot P_{CO}}{a_C}\right)} \quad (2)$$

FIG. 1 is a flowchart showing a basic configuration of a method for producing chromium-containing molten steel according to an embodiment of the present invention. As the first step, a raw material including a chromium-containing raw material is melted by use of a steelmaking refining furnace (S0). Subsequently, heating is performed by using electric energy, adding a heat source, or the like (S1). Further, the slag basicity is adjusted to be in the range of not less than 1.5 and not more than 3.0, and rough decarburization by oxygen blowing is performed (S2). After that, the slag basicity is adjusted to be in the range of not less than 2.0 and not more than 3.5, and then tapping is performed while keeping slag containing chromium oxide generated by the oxygen blowing remaining in the furnace (S3). Here, the slag basicity is determined by dividing a CaO concentration by an $SiO_2$ concentration on a mass basis in the slag. The heating is carried out, for example, by energization heating, an addition of a carbonaceous material or a silicon-containing substance and oxygen blowing, or the like.

Next, as the second step, the slag containing chromium oxide made to remain in the furnace is reduced by using a carbon source or a metal source newly added into the same furnace so that chromium is recovered into molten steel (S4), and thus chromium-containing molten steel can be effectively produced.

In the first step, in order to adjust the slag basicity to be in an appropriate range in accordance with the variation in the concentration of the chromium oxide in the slag during the oxygen blowing, a CaO-containing raw material may be added and melted during the oxygen blowing. Moreover, preferably, the CaO-containing raw material is added and melted, so that a slag basicity (C/S)pre before the rough decarburization by the oxygen blowing and a slag basicity (C/S)post after the rough decarburization by the oxygen blowing satisfy a formula (1) below. This makes it possible to stably produce chromium-containing molten steel.

$$(C/S)\text{post}-(C/S)\text{pre}\geq -0.2 \quad (1)$$

The CaO-containing raw material may be added and melted by newly adding the CaO-containing raw material during the oxygen blowing or by initially adding a CaO-containing raw material in the form of an agglomerate so as to be melted during the oxygen blowing. The melting rate of the raw material varies depending on the property of the raw material, the shape of a furnace, and the agitation status, and while there have been reported various estimated formulae to this end, the melting rate may be empirically estimated from an actual variation in basicity.

In the first step, weak reduction (S5) is carried out in which the chromium oxide concentration in the slag is adjusted to be in the range of not less than 5 mass % and not more than 50 mass % by using one or two types selected from an Si-containing raw material and an Al-containing raw material, and thus it is possible to more stably produce chromium-containing molten steel.

The following describes details of the present invention.

Figure 2:
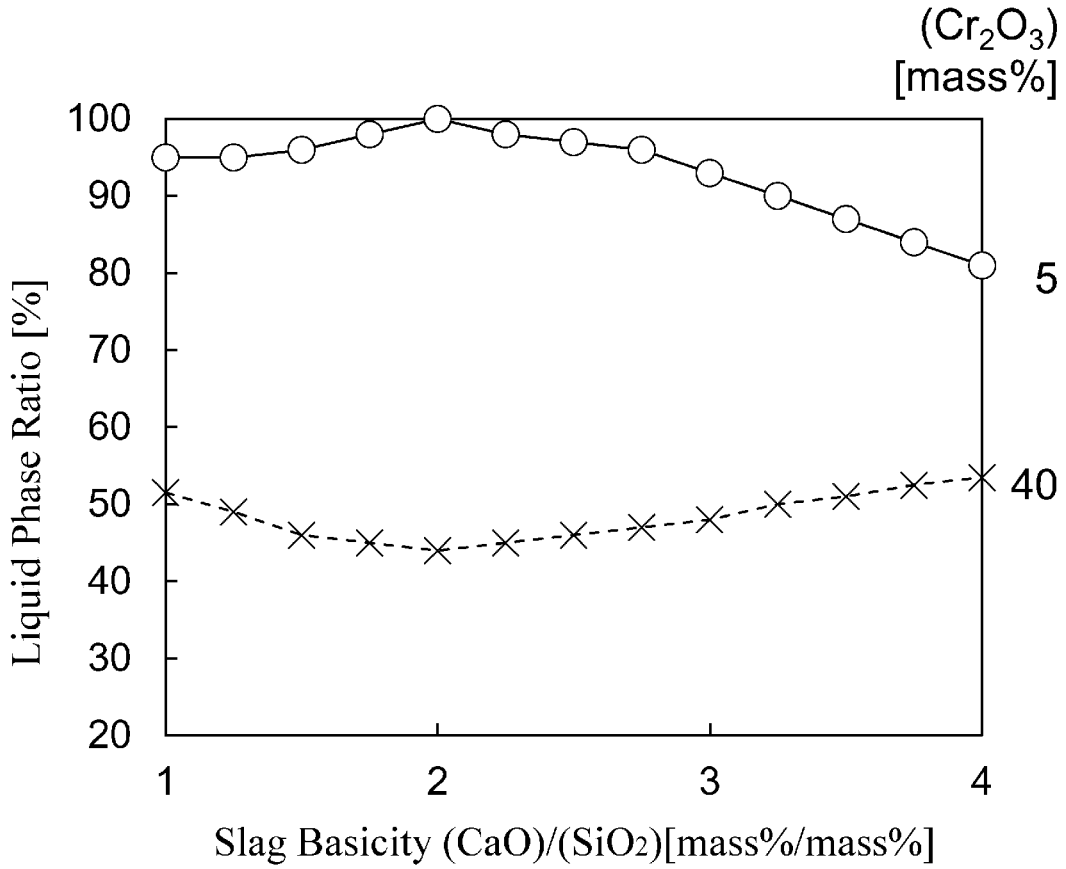
FIG. 2 is a graph showing a relationship between a slag basicity and a liquid phase ratio generated at 1700° C. with respect to different values of chromium oxide concentration in the slag, which is calculated by using thermodynamic calculation software.

Prior to making the invention, the inventors conducted a thermodynamic study on an equilibrium phase of slag varying in chromium oxide concentration. FIG. 2 shows a graph of an influence of a chromium oxide concentration on a relationship between the slag basicity and liquid phase ratio generated at 1700° C., which is calculated by using the thermodynamic calculation software "Factsage." Here, the MgO concentration and the $Al_2O_3$ concentration in the slag are set to 10 mass % and 10 mass %, respectively. These values of the MgO concentration and the $Al_2O_3$ concentration represent a slag composition in a typical refining furnace, and whether these concentrations are high or low has no significant influence on calculation results.

When the chromium concentration is low, i.e., for example, the $Cr_2O_3$ concentration in the slag is 5 mass % as shown in FIG. 2, a high liquid phase ratio can be retained at the slag basicity of a relatively low range of 1.0 to 3.0. Further, the liquid phase ratio decreases with an increase in basicity. From a viewpoint of promoting the reduction of chromium oxide, preferably, the slag basicity is retained at not less than 1.5, and preferably, the basicity during rough decarburization performed by starting oxygen blowing is set to be in the range of 1.5 to 3.0.

On the other hand, we found that, when the chromium concentration is high, i.e., for example, the chromium oxide concentration in the slag is 40 mass % as shown in FIG. 2, the liquid phase ratio increases as the slag basicity increases in the range of not less than 2.0. A liquid phase generated at the basicity in the range of less than 2.0 has extremely high viscosity with the basicity of about 1.2 and therefore might adhere to a furnace wall. The basicity in the liquid phase is determined by dividing a CaO concentration by an $SiO_2$ concentration on a mass basis in the liquid phase. In a low chromium concentration region, the liquid phase ratio is relatively high, and thus even when a liquid phase having high viscosity is generated, no operational problem is caused. When, however, a high chromium concentration region is established in the latter half of blowing, and thus a solid fraction of the slag is increasing, a pronounced influence of the viscosity is exerted on operations. In a case where the slag basicity is more than 3.5, hexavalent chromium is generated in the slag. From a viewpoint of addressing environmental problems, it is required that the slag basicity be set to not more than 3.5. Hence, preferably, the slag basicity at the end of oxygen blowing is set to be in the range of not less than 2.0 and not more than 3.5.

As described above, the basicity that allows the liquid phase ratio to reach maximum varies during the oxygen blowing in accordance with the variation of the concentration of chromium oxide during oxygen blowing. For this reason, it is preferable to intentionally add and melt a CaO-containing raw material during the oxygen blowing, so that the slag basicity (C/S)pre before rough decarburization by the oxygen blowing and the slag basicity (C/S)post after the rough decarburization by the oxygen blowing satisfy the formula (1) below. Note that the upper limit of the following formula (1) is 2.0.

$$(C/S)\text{post}-(C/S)\text{pre}\geq -0.2 \quad (1)$$

When the chromium oxide concentration is about 60 mass %, the basicity of the liquid phase portion hardly increases even at increased slag basicity. Thus, the chromium oxide concentration in slag is preferably set to not more than 50 mass %. When the chromium oxide concentration in slag is less than 5%, there might be a greater disadvantage of an increase in volume of the slag than an advantage that chromium can be recovered by using the carbon source or a metal source newly charged, and thus, it is preferable to set the chromium oxide concentration in slag to not less than 5%. After the oxygen supply is stopped, an Si-containing raw material or Al-containing raw material is added in a proper amount, so that the chromium oxide concentration can be adjusted to be in this range. In this case, while, with the Si-containing raw material added, the slag basicity varies between after oxygen blowing and after weak reduction, preferably, the slag basicity after the oxygen blowing and the slag basicity after the weak reduction are both set to be in the range of not less than 2.0 and not more than 3.5.

The slag basicity before the start of rough decarburization by oxygen blowing, the slag basicity after the end of the oxygen blowing, and the slag basicity after weak reduction each can be controlled by designing the weight and timing of an addition of an auxiliary raw material to be charged during blowing.

When slag containing chromium oxide is made to remain in the furnace, chromium can be reduced and recovered by adding a carbon source or a metal source to the slag containing chromium oxide. Examples of the carbon source include hot metal, high-carbon ferrochrome, and carbonaceous material, which are separately prepared. Examples of the metal source include ferrosilicon, aluminum pellets, and aluminum dross. Since the reduction reaction of chromium oxide with carbon is an endothermic reaction, heating may be performed by energization heating or by supplying oxygen for heat supply. In the subsequent step, with the slag composition adjusted again, tapping may be performed while keeping the slag containing chromium oxide remaining in the furnace or performed after adding a metal reducing agent and then removing the slag.

EXAMPLES

Example 1

Hot metal was charged in a 150-ton converter and ferrochromium was added thereto, and then decarburization blowing was carried out to perform heating and decarburization, followed by tapping. Hot metal was charged again in the furnace after the tapping, slag containing chromium oxide was reduced so as to recover chromium, while heating by oxygen-blowing decarburization was carried out. Table 1 shows experimental conditions.

TABLE 1

| | Slag Composition [mass %] After End of Heating | | | | | Slag Composition [mass %] After Oxygen-blowing Decarburization | | | | |
|---|---|---|---|---|---|---|---|---|---|---|
| No. | $Cr_2O_3$ | CaO | $SiO_2$ | $Al_2O_3$ | C/S* | $Cr_2O_3$ | CaO | $SiO_2$ | $Al_2O_3$ | C/S* |
| 1 | 10 | 40 | 10 | 13 | 4.00 | 53 | 20 | 4 | 5 | 5.00 |
| 2 | 5 | 37 | 23 | 14 | 1.61 | 53 | 16 | 11 | 7 | 1.45 |
| 3 | 7 | 30 | 22 | 13 | 1.36 | 54 | 20 | 10 | 8 | 2.00 |
| 4 | 9 | 38 | 13 | 20 | 2.92 | 55 | 25 | 5 | 8 | 5.00 |
| 5 | 5 | 43 | 17 | 10 | 2.53 | 53 | 21 | 9 | 5 | 2.33 |
| 6 | 9 | 42 | 15 | 10 | 2.80 | 55 | 20 | 8 | 5 | 2.50 |
| 7 | 10 | 40 | 18 | 14 | 2.22 | 57 | 24 | 8 | 7 | 3.00 |
| 8 | 7 | 40 | 14 | 14 | 2.86 | 53 | 23 | 7 | 7 | 3.29 |

| | Reduction Before | Slag Composition [mass %] Before Tapping | | | | | Tapping Temperature | |
|---|---|---|---|---|---|---|---|---|
| No. | Tapping | $Cr_2O_3$ | CaO | $SiO_2$ | $Al_2O_3$ | C/S* | [° C.] | Remarks |
| 1 | Strong Reduction | 1 | 44 | 20 | 10 | 2.20 | 1700 | Comparative Example |
| 2 | Not performed | 53 | 16 | 11 | 7 | 1.45 | 1700 | Comparative Example |
| 3 | Not performed | 54 | 20 | 10 | 8 | 2.00 | 1700 | Comparative Example |
| 4 | Not performed | 55 | 14 | 11 | 8 | 1.27 | 1700 | Comparative Example |
| 5 | Not performed | 53 | 21 | 9 | 5 | 2.33 | 1700 | Invention Example |
| 6 | Weak Reduction | 38 | 21 | 12 | 7 | 1.75 | 1700 | Invention Example |
| 7 | Not performed | 57 | 21 | 9 | 7 | 2.33 | 1700 | Invention Example |
| 8 | Weak Reduction | 44 | 24 | 11 | 9 | 2.18 | 1700 | Invention Example |

*Slag basicity; representing (CaO concentration)/($SiO_2$ concentration) on mass basis Next, the status of a furnace throat was checked with respect to the experimental conditions shown in Table 1 for the evaluation of an influence on operations. Table 2 shows results thereof. Here, the evaluation of operational stability is conducted by evaluating the reduction rate in area of the furnace throat from photographs of the furnace throat as a degree of clogging of the furnace throat. A case where an amount of reduction in the area of the furnace throat after the process was not less than 1% of the area of the furnace throat before the process was evaluated as "poor," a case where the amount was less than 1% was evaluated as "good," and a case where there was observed no reduction in the area of the furnace throat was evaluated as "excellent." The used amount of the reducing agent is evaluated as "poor" when the used amount of the metal reducing agent, namely, the used amount of ferrosilicon and aluminum pellets was equal to a conventional one, and as "good" when the amount was smaller than a conventional one. Moreover, the percentage of chromium that could be recovered in the second step was evaluated as a recovery rate of chromium. Here, the recovery rate of chromium was calculated, on a mass basis, by (chromium concentration (%) in molten metal×tapping amount (t)/100−amount (t) of chromium added)/amount (t) of chromium remaining in the furnace. The recovery rate of chromium of less than 0.3 was evaluated as "poor," and the recovery rate of chromium of not less than 0.3 was evaluated as "good." As a comprehensive evaluation, a condition under which any of the operational stability, the used amount of a reducing agent, and the recovery rate of chromium was evaluated as "poor" was evaluated as "poor," while among conditions under which no evaluation was made as "poor," a condition under which the operational stability was evaluated as "excellent" was evaluated as "excellent," and any other condition was evaluated as "good."

TABLE 2

| No. | Evaluation of Operational Stability | Evaluation of Used Amount of Reducing Agent | Recovery Rate of Chromium | Comprehensive Evaluation | Remarks |
|---|---|---|---|---|---|
| 1 | Excellent | Poor | Poor | Poor | Comparative Example |
| 2 | Poor | Good | Poor | Poor | Comparative Example |
| 3 | Poor | Good | Poor | Poor | Comparative Example |
| 4 | Poor | Good | Poor | Poor | Comparative Example |
| 5 | Good | Good | Good | Good | Invention Example |
| 6 | Excellent | Good | Good | Excellent | Invention Example |
| 7 | Good | Good | Good | Good | Invention Example |
| 8 | Excellent | Good | Good | Excellent | Invention Example |

Under all process conditions Nos. 5 to 8 representing invention examples, it was possible to reduce and recover chromium and to decrease the used amount of the reducing agent. Moreover, under the process conditions Nos. 6 and 8 in which the chromium oxide concentration in the slag was adjusted to not less than 5 mass % and not more than 50 mass %, the rate of narrowing of the furnace throat was relatively reduced.

The foregoing examples have shown an example of stably producing chromium-containing molten steel at reduced costs and without affecting operations, and in the chromium-containing molten steel tapped according to the present invention, the oxygen concentration in the molten steel is high, and thus nitrogen absorption is unlikely to occur, so that the method is useful also as a method for obtaining high-purity molten steel. While the molten steel tapped by this method has a high oxygen concentration in the molten steel and thus is tapped in a state of having a relatively high sulfur concentration, a desulfurization process can be performed with no problem by performing a reduction process in a later step. In addition, there is no need to reduce an oxide in slag, and thus a use amount of an alloy reducing agent such as an Si-containing raw material or an Al-containing raw material can be significantly reduced. It is also useful to produce molten steel having a predetermined component concentration by combining molten steel tapped by this method and molten steel produced in a different refining vessel.

INDUSTRIAL APPLICABILITY

The method for producing chromium-containing molten steel according to the present invention is industrially useful in that it is capable of reducing a cost and an amount of generated slag and thus of reducing an environmental burden.

The invention claimed is:

1. A method for producing chromium-containing molten steel comprising, using a steelmaking refining furnace, melting and heating a raw material containing a chromium-containing raw material, wherein the method includes:

adjusting slag basicity to be in a range of not less than 1.5 and not more than 3.0, then performing rough decarburization by oxygen blowing, wherein after the rough decarburization by oxygen blowing a concentration of chromium oxide in the slag exceeds 50 mass %, then, after the rough decarburization by oxygen blowing (i) adjusting the slag basicity to be in a range of not less than 2.0 and not more than 3.5, and (ii) adjusting the concentration of the chromium oxide in the slag to be in a range of not less than 5 mass % and not more than 50 mass % by adding an amount of one or two raw materials that are selected from a Si-containing raw material and an Al-containing raw material, and then, after adjusting the concentration of the chromium oxide in the slag, performing tapping while keeping the slag containing chromium oxide generated by the oxygen blowing remaining in the furnace; and then reducing the remaining slag containing chromium oxide by a carbon source or a metal source newly added into the same furnace to recover chromium into molten steel, wherein:

the slag basicity is determined by dividing a CaO concentration by a $SiO_2$ concentration on a mass basis in the slag.

2. The method for producing chromium-containing molten steel according to claim 1, wherein a CaO-containing raw material is added and melted during the oxygen blowing.

3. The method for producing chromium-containing molten steel according to claim 2, wherein a slag basicity $(C/S)_{pre}$ before the rough decarburization by the oxygen blowing and a slag basicity $(C/S)_{post}$ after the rough decarburization by the oxygen blowing satisfy a formula (1) below $$(C/S)_{post}-(C/S)_{pre}\geq -0.2 \quad (1).$$

4. The method for producing chromium-containing molten steel according to claim 1, wherein a slag basicity $(C/S)_{pre}$ before the rough decarburization by the oxygen blowing and a slag basicity $(C/S)_{post}$ after the rough decarburization by the oxygen blowing satisfy a formula (1) below $$(C/S)_{post}-(C/S)_{pre}\geq -0.2 \quad (1).$$

* * * * *